US010774455B2

(12) United States Patent
Kim

(10) Patent No.: US 10,774,455 B2
(45) Date of Patent: Sep. 15, 2020

(54) WASHING MACHINE

(71) Applicant: Samsung Electronics Co., Ltd, Gyeonggi-do (KR)

(72) Inventor: Seung-Hoon Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 246 days.

(21) Appl. No.: 15/356,491

(22) Filed: Nov. 18, 2016

(65) Prior Publication Data

US 2017/0137985 A1 May 18, 2017

(30) Foreign Application Priority Data

Nov. 18, 2015 (KR) ..... 10-2015-0161487

(51) Int. Cl.
*D06F 37/10* (2006.01)
*D06F 39/14* (2006.01)
*D06F 37/28* (2006.01)

(52) U.S. Cl.
CPC ..... *D06F 37/10* (2013.01); *D06F 37/28* (2013.01); *D06F 39/14* (2013.01)

(58) Field of Classification Search
CPC ..... D06F 37/10; D06F 37/28; D06F 39/14
USPC ..... 68/139
See application file for complete search history.

(56) References Cited

U.S. PATENT DOCUMENTS 1,549,965 A * 8/1925 Everett ..... D06F 37/10 68/139
2,500,062 A * 3/1950 Clark ..... D06F 58/08 34/139
5,357,772 A * 10/1994 Hendren ..... D06F 95/00 68/210
7,712,338 B2 * 5/2010 Tanaka ..... D06F 35/001 68/212
2003/0110817 A1 * 6/2003 Nitschmann ..... D06F 37/266 68/139
2004/0084276 A1 * 5/2004 Repic ..... B65G 11/20 193/34

(Continued)

FOREIGN PATENT DOCUMENTS

CN 104963160 A * 10/2015
EP 2602378 B1 * 2/2017 ..... D06F 39/022

(Continued)

OTHER PUBLICATIONS

Machine translation of CN-104963160-A, dated Oct. 2015. (Year: 2015).*

*Primary Examiner* — Joseph L. Perrin
*Assistant Examiner* — Kevin G Lee

(57) ABSTRACT

A washing machine is disclosed, which prevents bubbles in the drum from leaking outside when an auxiliary door is opened during a washing process. The washing machine includes a cabinet including a first opening, a tub disposed in the cabinet and configured to store wash water therein, a drum rotatably disposed in the tub, a door assembly mounted to the cabinet to open or close the first opening, and including a second opening, an auxiliary door configured to open or close the second opening, and an interference part located at a rear of the auxiliary door to form a predetermined space in the rear part of the auxiliary door.

10 Claims, 10 Drawing Sheets

(56) References Cited

U.S. PATENT DOCUMENTS

| | | | | |
|---|---|---|---|---|
| 2013/0002113 | A1* | 1/2013 | Loss | D06F 37/28<br>312/291 |
| 2015/0211167 | A1* | 7/2015 | Kim | D06F 37/10<br>68/140 |
| 2015/0292135 | A1* | 10/2015 | Wishney | D06F 37/10<br>68/139 |

FOREIGN PATENT DOCUMENTS

| | | | |
|---|---|---|---|
| JP | 2012228409 | A * | 11/2012 |
| KR | 10-2004-0015480 | | 2/2004 |

* cited by examiner

WASHING MACHINE

CROSS-REFERENCE TO RELATED APPLICATION(S) AND CLAIM OF PRIORITY

This application claims the benefit of Korean Patent Application No. 10-2015-0161487, filed on Nov. 18, 2015 in the Korean Intellectual Property Office, the disclosure of which is incorporated herein by reference.

TECHNICAL FIELD

Embodiments of the present disclosure relate to a washing machine for allowing a user to easily put laundry into or take laundry out of the washing machine.

BACKGROUND

Generally, a washing machine is an apparatus to wash laundry using electricity. Washing machines are classified into a drum washing machine and a vertical-axis washing machine. The drum washing machine is provided with a rotary tub horizontally arranged, such that laundry is washed by having the laundry lifted along an inner circumferential surface of a rotary tub and fallen when the rotary tub rotates about a horizontal axis thereof in forward and backward directions. The vertical-axis washing machine is provided with a rotary tub including a pulsator vertically arranged, such that laundry is washed using a water stream generated by the pulsator when the rotary tub rotates about a vertical axis thereof in forward and backward directions.

Generally, the drum washing machine includes a cabinet, a tub placed within the cabinet to store wash water therein, and a drum rotatably installed in the tub to receive laundry to be washed therein. An opening may be provided in the cabinet, and the opening may be opened or closed by a door.

The drum rotates to agitate laundry along with wash water on the condition that the laundry, detergent, and the wash water are put into the drum, such that dirt or stains are removed from the laundry. The laundry is put into the tub through the opening provided in the cabinet, and detergent and wash water are supplied by a detergent supply device.

If a washing process of the drum washing machine starts operation, the door of the drum washing machine remains locked. In order to allow laundry to be easily put into or taken out of the drum during the washing process, the door of the drum washing machine may include an auxiliary door to be freely opened or closed at any time desired by a user.

If the auxiliary door is opened during the washing process, detergent bubbles generated in the drum may leak outside through the opening opened or closed by the auxiliary door.

SUMMARY

Therefore, it is an aspect of the present disclosure to provide a washing machine having an improved structure for preventing leakage of detergent bubbles generated in the drum located into a space behind the auxiliary door.

It is another aspect of the present disclosure to provide a washing machine having an improved structure of a sealing part located in an opening part opened or closed by an auxiliary door so that bubbles in the drum are prevented from flowing through the opening part Additional aspects of the invention will be set forth in part in the description which follows and, in part, will be obvious from the description, or may be learned by practice of the invention.

In accordance with one aspect of the present disclosure, a washing machine includes: a cabinet including a first opening; a tub disposed in the cabinet and configured to store wash water; a drum rotatably disposed in the tub; a door assembly mounted to the cabinet to open or close the first opening and including a second opening; an auxiliary door configured to open or close the second opening; and an interference part located at a rear of the auxiliary door to form a predetermined space in the rear part of the auxiliary door.

The interference part may be an auxiliary door glass mounted to the auxiliary door.

The auxiliary door glass may protrude backward of the auxiliary door.

The auxiliary door glass may simultaneously move together with the auxiliary door.

The washing machine may further include a connection part configured to connect the auxiliary door to the drum.

When the auxiliary door is closed, the auxiliary door glass may be accommodated in the connection part.

A sealing member may be mounted to the outer side of the auxiliary door glass.

The sealing member may seal a space between the auxiliary door glass and the connection part when the auxiliary door is closed.

The auxiliary door glass may include: a side surface part protruding backward from the auxiliary door; and a rear surface part connected to the side surface part and located to face the auxiliary door.

The auxiliary door and the auxiliary door glass may be formed of transparent material.

The washing machine may further include a connection part configured to connect the auxiliary door to the drum.

One side of the connection part may be opened or closed by a cap.

The cap may close one side of the connection part in so far as no external force occurs.

The cap may be configured to rotate about a rotation shaft.

The rotation shaft may include an elastic member configured to provide the cap with an elastic force in a direction the cap closes the one side of the connection part.

The cap may open the one side of the connection part by an external force in an opposite direction to the elastic force applied to the elastic member.

The cap may be spaced apart from the auxiliary door.

The washing machine may further include: a front sealing part located at a front of the connection part to seal a space between the connection part and the auxiliary door.

A portion of a lower part of the front sealing part may be extended upward to partially cover the second opening.

The front sealing part may be formed of material that enables the front sealing part to be deformed by an external force.

In accordance with another aspect of the present disclosure, a washing machine includes: a cabinet including a first opening; a drum disposed in the cabinet to store wash water therein; a door assembly mounted to the cabinet to open or close the first opening, and including a second opening; an auxiliary door configured to open or close the second opening; and an interference part located at a rear of the auxiliary door to prevent the auxiliary door from making contact with wash water or detergent bubbles in the drum.

The interference part may be an auxiliary door glass mounted to a rear of the auxiliary door while protruding backward of the auxiliary door.

The washing machine may further include a connection part configured to connect the auxiliary door to the drum.

The connection part may include a cap configured to selectively open one side of the connection part.

An elastic member is connected to the cap such that an elastic force of the elastic member allows the cap to keep shielding the one side of the connection part unless an external force occurs.

The connection part may include a front sealing part configured to seal a space between the connection part and the auxiliary door.

The front sealing part may cover at least one portion of the second opening.

The front sealing part may be formed of material which allows the front sealing part to be deformed by an external force.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
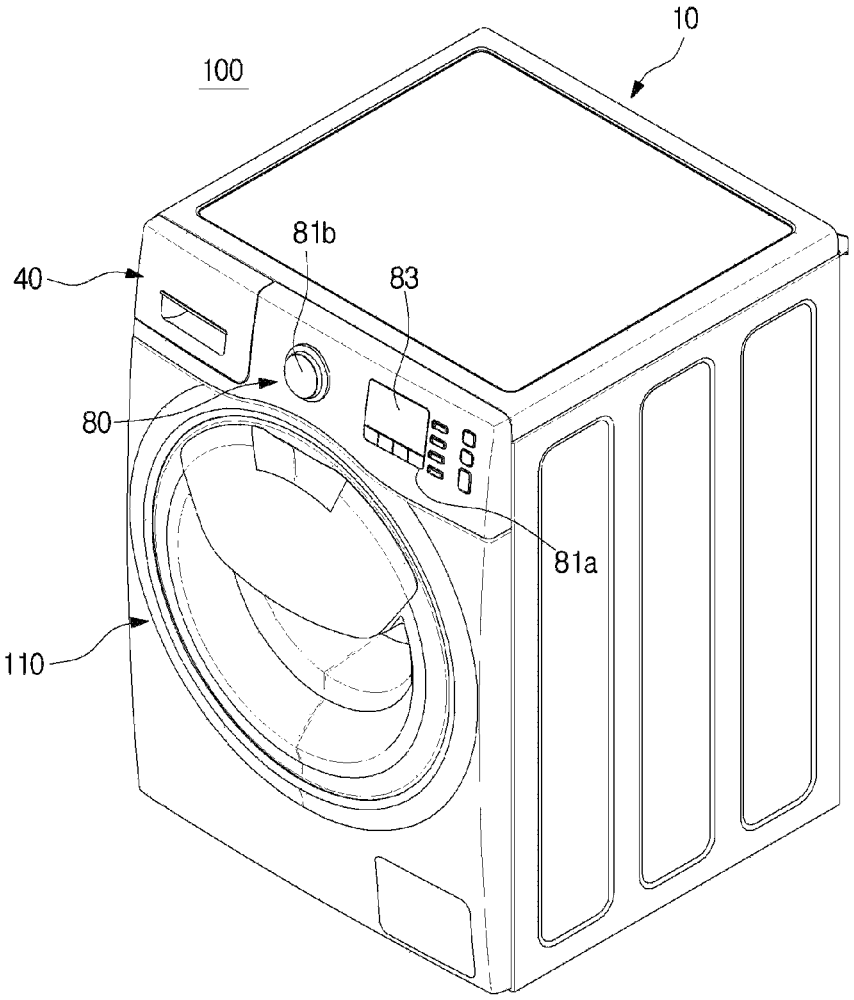
FIG. 1 is a perspective view illustrating an external appearance of a washing machine according to an embodiment of the present disclosure.

Reference will now be made in detail to the embodiments of the present disclosure, examples of which are illustrated in the accompanying drawings, wherein like reference numerals refer to like elements throughout.

Figure 2:
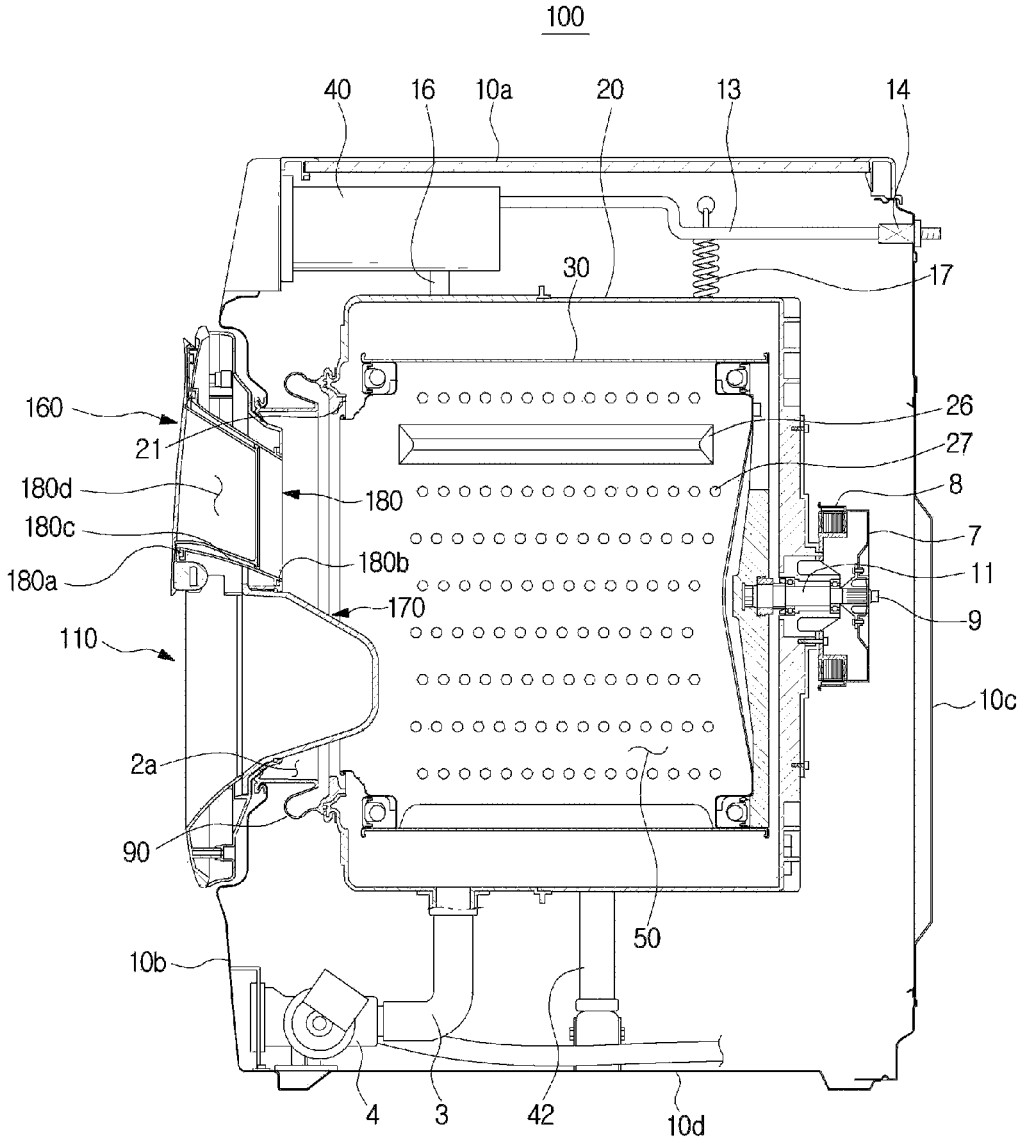
FIG. 2 is a cross-sectional view illustrating a washing machine according to an embodiment of the present disclosure.

FIG. 1 is a perspective view illustrating an external appearance illustrating a washing machine according to an embodiment of the present disclosure. FIG. 2 is a cross-sectional view illustrating a configuration of a washing machine according to an embodiment of the present disclosure.

Referring to FIGS. 1 and 2, the washing machine 100 may include a cabinet 10, a tub to receive wash water to be used for a washing process or rinse water to be used for a rinsing process, and a drum 30 to accommodate laundry therein.

The cabinet 10 may include input units 81*a* and 81*b* to receive operation commands for the washing machine 1 from a user, and a control panel 80 including a display 83 displaying operation information of the washing machine 1.

The input units 81*a* and 81*b* may receive user commands related to the operations of the washing machine 1, for example, various commands related to a washing time, the number of rinsing times, a dehydration time, a drying time, operation start/stop/pause functions, etc. The input units 81*a* and 81*b* may include a press button 81*a* and a rotary button 81*b*. In addition, the display 83 may display information regarding the operations of the washing machine 1, for example, the amount of wash water, a current execution process of the washing machine 1, the remaining time to complete laundry washing, etc. The display 83 may include a Liquid Crystal Display (LCD) panel, a Light Emitting Diode (LED) panel, etc.

Although the washing machine 1 according to the embodiment includes the input units 81*a* and 81*b* and the display 83 separated from the input units 81*a* and 81*b* for convenience of description, the scope or spirit of the present disclosure is not limited thereto, and it should be noted that the washing machine 1 may include a Touch Screen Panel (TSP) in which the input units 81*a* and 81*b* are incorporated with the display 83 as necessary.

The cabinet 10 includes frames 10*a*, 10*b*, 10*c* and 10*d*. The frames 10*a*, 10*b*, 10*c* and 10*d* may include a top frame 10*a* to form a top surface of the cabinet 10, a front frame 10*b* to form a front surface of the cabinet 10, a rear frame 10*c* to form a rear surface of the cabinet 10, and a side frame (not shown) and a bottom frame 10*d* to respectively form a side surface and a bottom surface of the cabinet 10 while connecting the front frame 10*b* to the rear frame 10*c*.

A first opening 2*a* may be formed at the front frame 10*b* of the cabinet 10 such that a user can put laundry into or withdraw laundry from the drum 30 through the first opening 2*a*. The first opening 2*a* may be opened or closed by a door assembly 110 installed at the front frame 10*b* of the cabinet 10.

A diaphragm 90 may connect the cabinet 10 to the tub 20. In detail, the diaphragm 90 may be disposed between the first opening 2*a* of the cabinet 10 and an opening 21 of the tub 20 corresponding to the first opening 2*a*.

The diaphragm 90 may form a passage from the first opening 2*a* of the cabinet 10 to the opening 21 of the tub 20. During rotation of the drum 30, the diaphragm may reduce vibration delivered to the front frame 10*b*. Some parts of the diaphragm 90 may be disposed between the door assembly 110 and the front frame 10*b* so as to prevent wash water of the tub 20 from leaking outside the cabinet 10.

The diaphragm 90 may include an injection-molded product formed of a thermoplastic elastomer. Since the thermoplastic elastomer has elasticity at the room temperature in the same manner as in rubber, the diaphragm 90 formed of the thermoplastic elastomer may effectively reduce vibration delivered from the tub 20 to the front frame 10*b* of the cabinet 10.

A spring 17 may be provided between the tub 20 and the cabinet 10 to support the tub 20 at an upper portion of the washing machine 100. The spring 17 may reduce vibration and noise generated by movement of the tub 20 through elastic force.

A water supply pipe 13 to supply water (wash water or rinse water) to the tub 20 may be installed at an upper portion of the tub 20. A water supply valve 14 may be installed at one side of the water supply pipe 13.

A detergent supply device 40 may be connected to the tub 20 through a connection pipe 16. Water received through the water supply pipe 13 may be mixed with detergent through a detergent supply device 40, and then supplied into the tub 20.

The tub 20 may be supported by a damper 42. The damper 42 may connect the outer surface of the tub 20 to the inner bottom surface of the cabinet 10. In addition, the damper 42 may also be located at the upper side and the left and right sides of the cabinet 10 in addition to the inside bottom surface of the cabinet 10 so as to support the tub 20. The damper 42 or the spring 17 may attenuate vibration and impact caused by vertical motion of the tub 20 above and below the tub 20.

The tub 20 may be supported by at least one damper 42.

The rear surface of the drum 30 may be connected to a drive shaft 11 to which a drive motor 7 transmits power. A plurality of through-holes 27 through which wash water passes may be formed around the drum 30. A plurality of lifters 26 may be installed on an inner circumferential surface of the drum 30 so that laundry may be lifted or fallen during rotation of the drum 30.

The drive shaft 11 may be disposed between the drum 30 and the drive motor 7. One end of the drive shaft 11 may be connected to a rear plate of the drum 30, and the other end of the drive shaft 11 may extend outside a rear wall of the tub 20. When the drive motor 7 drives the drive shaft 11, the drum 30 connected to the drive shaft 11 may rotate around the drive shaft 11.

The rear wall of the tub 20 is provided with a bearing housing 8 so as to rotatably support the drive shaft 11. The bearing housing 8 may be formed of aluminum alloy, and be inserted into the rear wall of the tub 20 during injection molding of the tub 22. Bearings 9 may be installed between the bearing housing 8 and the drive shaft 11 so that the drive shaft 11 may be smoothly rotated.

The tub 20 is provided, at a lower portion thereof, with a drain pump 4 to discharge water within the tub 20 to the outside of the cabinet 10, a connection hose 3 connecting the tub 20 to the drain pump 4 such that water in the tub 20 may be introduced into the drain pump 4, and a drain hose (not shown) configured to guide water pumped by the drain pump 4 to the outside of the cabinet 10.

The door assembly 110 may include a door frame 120 provided to be pivot with respect to the cabinet 10.

Figure 3:
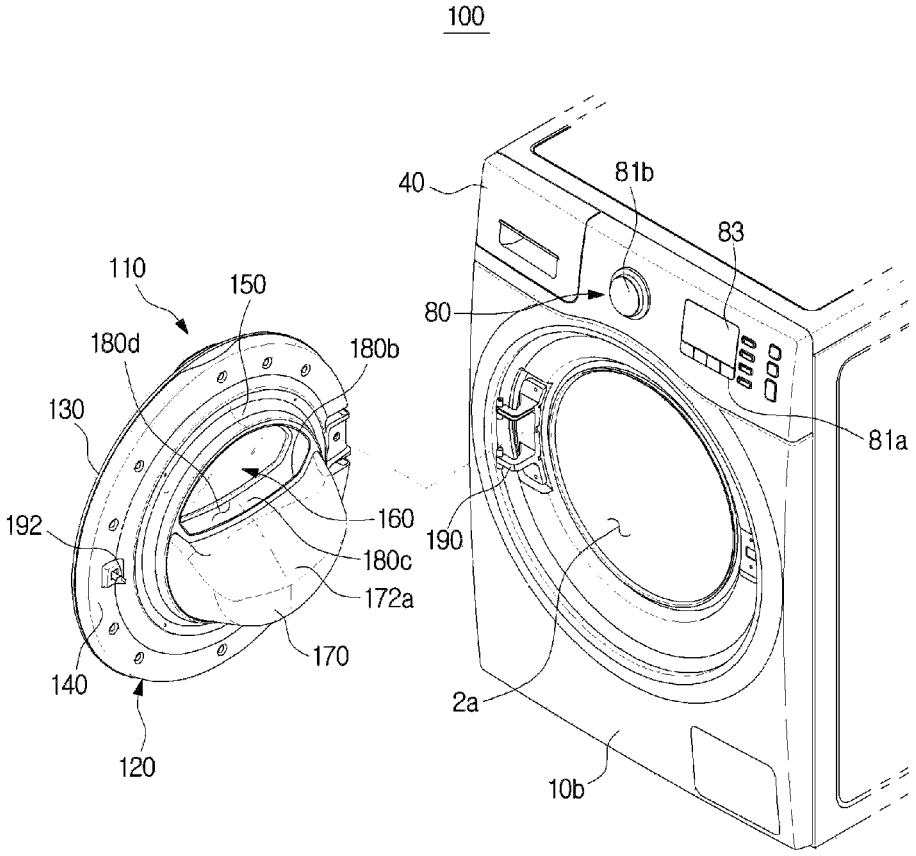
FIG. 3 is a view illustrating a cabinet and a door assembly of the washing machine separated from each other according to an embodiment of the present disclosure.
Figure 4:
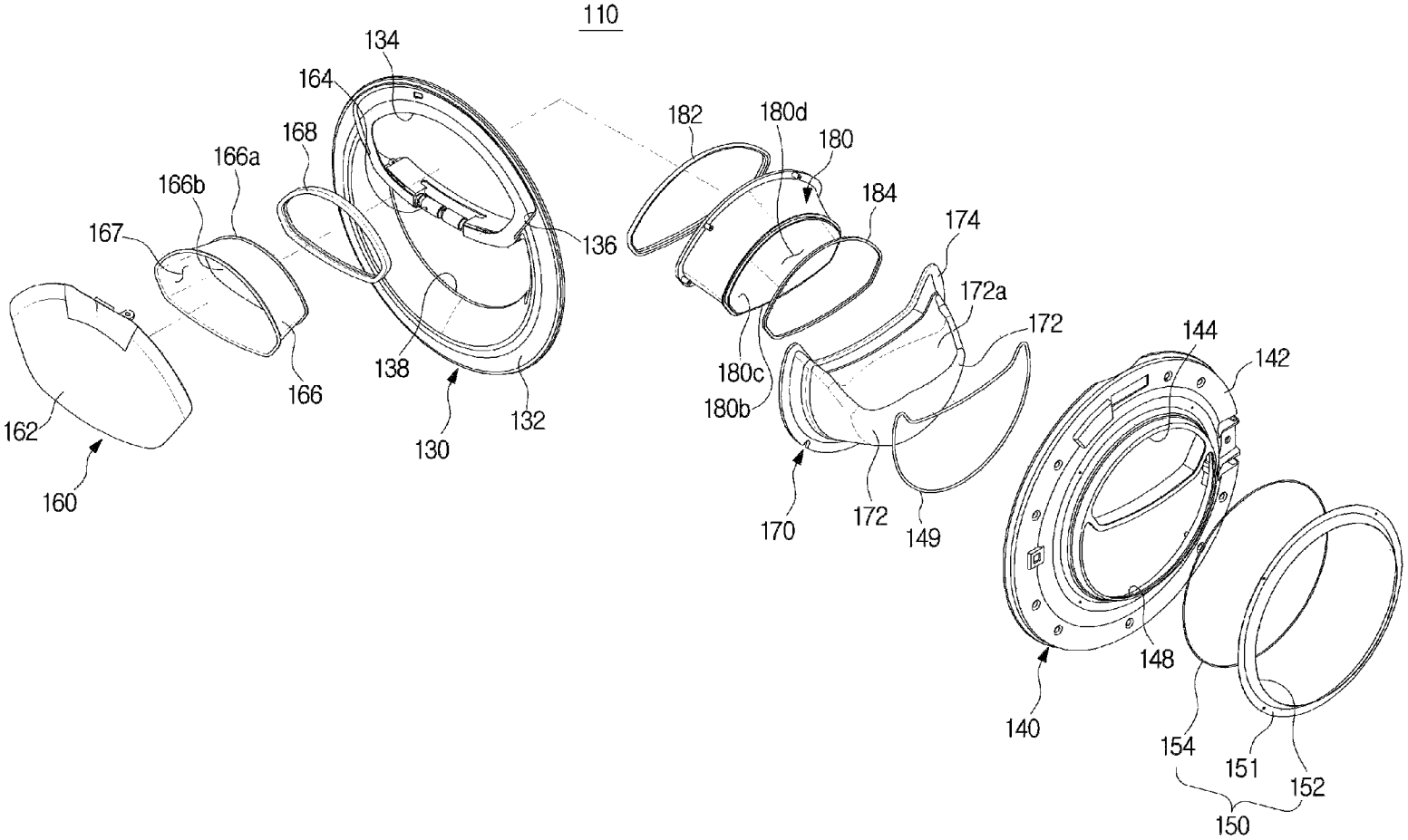
FIG. 4 is an exploded perspective view illustrating a door assembly according to an embodiment of the present disclosure.
Figure 5:
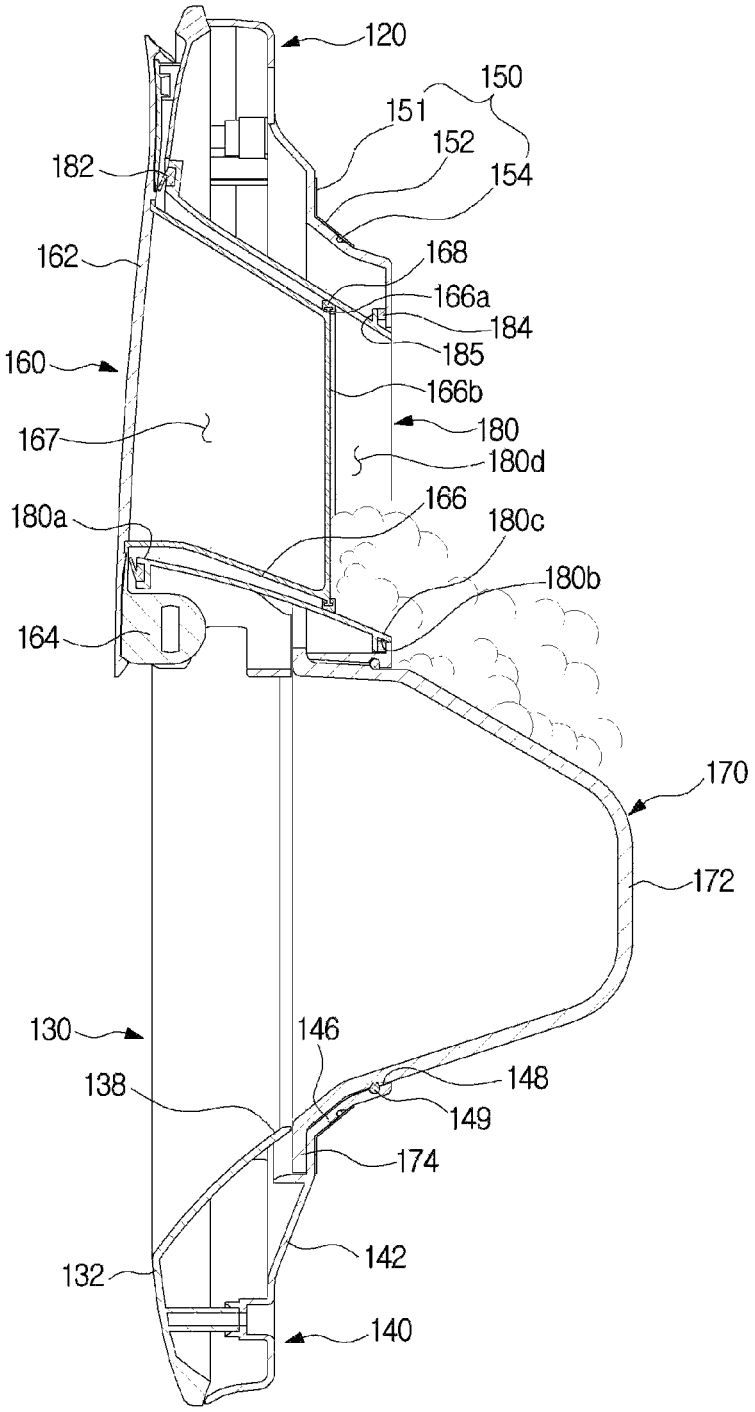
FIG. 5 is a view illustrating a door assembly according to an embodiment of the present disclosure.

FIG. 3 is a view illustrating a cabinet and a door assembly of the washing machine which are separated from each other according to an embodiment of the present disclosure. FIG. 4 is an exploded perspective view illustrating the door assembly according to an embodiment of the present disclosure. FIG. 5 is a view illustrating the door assembly according to an embodiment of the present disclosure.

Referring to FIGS. 3 to 5, the door assembly 110 provided in the washing machine 100 may include a door frame 120 configured to pivot with respect to the cabinet 10.

The door frame 120 may include a front cover 130 and a rear holder 140.

The front cover 130 may form the front surface of the door frame 120, and the rear holder 140 may form at least one portion of the rear surface of the door frame 120. The rear holder 140 may be provided to correspond to the first opening 2*a*. When the door assembly 110 covers the first opening 2*a*, the rear holder 140 may make contact with the first opening 2*a*.

The door assembly 110 may include a door glass 170. When the door assembly 110 is positioned to cover the first opening 2*a*, the door glass 170 may seal the interior of the cabinet 10 by making contact with the diaphragm 90.

The door frame 120 may include a second opening 180*a* configured to be opened or closed independently of the first opening 2*a*. The door assembly 110 may include an auxiliary door 160 configured to open or close the second opening 180*a*. The first opening 2*a* may be opened or closed by the door frame 120, and the second opening 180*a* may be opened or closed by the auxiliary door 160. The first opening 2*a* and the second opening 180*a* may be independently opened or closed from each other.

The second opening 180*a* may be one part of the first opening 2*a*, or the second opening 180*a* may be provided not to overlap the first opening 2*a*. For example, the second opening 180*a* may form a part of the first opening 2*a* while overlapping an upper part of the first opening 2*a*. The second opening 180*a* may also be separately provided over the first opening 2*a*. The following embodiment will disclose an exemplary case in which the second opening 180*a* forms an upper part of the first opening 2*a*.

The second opening 180*a* is provided on the first opening 2*a*. Thus, although the auxiliary door 160 is opened during the washing operation, wash water or detergent bubbles in the drum 30 may be prevented from leaking outside through the second opening 180*a*.

Even when the first opening 2*a* is closed by the door frame 120, the user may additionally put laundry or detergent into the cabinet through the second opening 180*a* by opening the auxiliary door 160. The door assembly 110 may include a door pivoting part 190 and a door locking part 192. The door frame 120 may pivot about the door pivoting part 190 with respect to the cabinet 10. The door pivoting part 190 may be connected to one side of the door frame 120. The door pivoting part 190 may allow the door frame 120 to rotate with respect to the cabinet 10 to open or close the first opening 2*a*.

The door locking part 192 may be coupled to the other side of the door frame 120. When the door frame 120 covers the first opening 2*a*, the door frame 120 is kept locked by the door locking part 192 unless receiving an external force. An insertion part corresponding to the door locking part 192 may be provided in the cabinet 10. When the door frame 120 covers the first opening 2*a*, the door locking part 192 may be inserted into the inserting part.

The front cover 130 may include a cover body 132. The cover body 132 may be provided with a cover opening 134. When the front cover 130 is closed, the cover opening 134 may be positioned to correspond to the second opening 180*a*. A front end of a connection part 180 forming the second opening 180*a* may be positioned at an inside of the cover opening 134. The cover body 132 may be provided to form the front surface of the door assembly 110.

The auxiliary door 160 may open or close the second opening 180*a*. The auxiliary door 160 may pivot with respect to the front cover 130.

The auxiliary door 160 may include an auxiliary door body 162 corresponding to the second opening 180*a*, and an auxiliary door hinge part 164 provided at one side of the auxiliary door body 162 such that the auxiliary door body 162 is able to be pivoted. The auxiliary door hinge part 164 may be provided at one side of the cover body 133.

The auxiliary door body 162 may have a width equal to or larger than the width of the second opening 180*a*, such that the second opening 180*a* is stably closed when the auxiliary door 160 closes the second opening 180*a*.

The auxiliary door 160 may include an auxiliary door glass 166. The auxiliary door glass 166 may be positioned at the rear of the auxiliary door body 162. The auxiliary door glass 166 may be mounted to the rear of the auxiliary door body 162 so as to be pivoted together with the auxiliary door body 162 about the auxiliary door hinge part 164. When the auxiliary door 160 is closed, the auxiliary door glass 166 may be accommodated in the connection part 180 configured to connect the auxiliary door 160 to the drum 30.

The auxiliary door body 162 and the auxiliary door glass 166 may be formed of transparent material such that a user who is located outside the washing machine 100 may view the inner space of the drum 30 on the condition that the auxiliary door 160 closes the second opening 180*a*. The auxiliary door body 162 and the auxiliary door glass 166 may be formed of opaque material.

The auxiliary door glass 166 may convexly protrude backward from the auxiliary door body 162. The auxiliary door glass 166 may include a side surface part 166*a* protruding backward from the auxiliary door body 162. A front end of the side surface part 166*a* may be mounted to the auxiliary door body 162. The side surface part 166*a* may be provided at a rear side thereof with a rear surface part 166*b* connected to the side surface part 166*a*. A predetermined space 167 may be provided by the auxiliary door glass 166, the side surface part 166*a* of the auxiliary door glass 166 and the rear surface part 166*b* of the auxiliary door glass 166.

In this case, when the side surface part 166*a* of the auxiliary door glass 166 protrudes backward from the auxiliary door body 162 by a length identical to or shorter than a length by which the door glass 170 protrudes backward of the front cover 130.

A sealing member 168 may be mounted to the rear of the auxiliary door glass 166. The sealing member 168 may be provided in a shape corresponding to the outer surface of the auxiliary door glass 166. For example, when the side surface part 166*a* of the auxiliary door glass 166 is formed in a cylindrical shape, the sealing member 168 may be formed in a ring shape surrounding the outer surface of the side surface part 166*a*.

When the auxiliary door 160 is closed, the sealing member 168 may make contact with the inner surface of the connection part 180 such that the space between the auxiliary door glass 166 and the connection part 180 is sealed. The space between the auxiliary door glass 166 and the connection part 180 is sealed by the sealing member 168, so that wash water stored in the drum 30 is prevented from leaking to the space between the auxiliary door glass 166 and the connection part 180 during the washing operation.

As described above, the auxiliary door glass 166 is formed to protrude backward from the auxiliary door body 162 such that water and detergent bubbles in the drum 30 do not leak to the outside of the washing machine 100 even when the auxiliary door 160 is opened during the washing operation. In addition, the space between the auxiliary door glass 166 and the connection part 180 is sealed by the sealing member 168 so as to prevent leakage of wash water and detergent bubbles, such that leakage of wash water or detergent bubbles attached to the outer surface of the auxiliary door glass 177 may be prevented when the auxiliary door 160 is opened.

The front cover 130 may include an auxiliary door seating part 136. The auxiliary door seating part 136 may be concaved from the outer surface of the front cover 130. According to the structure, when the auxiliary door 160 closes the second opening 180*a*, at least one part of the auxiliary door body 162 is seated on the auxiliary door seating part 136, so that the second opening 180*a* is stably kept closed by the auxiliary door 160. In addition, according to the structure, a step difference between the outer surface of the auxiliary door 160 and the outer surface of the front cover 130 under the condition that the second opening 180*a* is closed by the auxiliary door 160 may be reduced or removed so that product quality and aesthetics may be improved.

The front cover 130 may include a front glass hole 138 formed to correspond to the door glass 170. The front glass hole 138 may be formed as an opening such that a user may view the inner space of the drum 30 through the door glass 170 arranged at the rear of the front cover 130. The front glass hole 138 may be provided at a lower side of the cover opening 134. Although the front glass hole 138 is illustrated as being formed as an opening, the present disclosure is not limited thereto. For example, the front glass hole 138 may be provided with a light transmission member (not shown) formed of transparent material so as to protect the door glass 170.

The door glass 170 may be formed of transparent material such that a user may view the inner space of the cabinet 10 through the door glass 170 even when the first opening 2*a* is closed by the door assembly 110. The door glass 170 may include a glass body 172 convexly protruding from the rear holder 140. The glass body 172 may be formed of transparent glass such that a user may view the inner space of the cabinet 10.

The door glass 170 may be arranged at a lower side of the second opening 180*a* in the door assembly 110. The glass body 172 may include an introduction guide surface 172*a*. The introduction guide surface 172*a* may be formed at an upper side of the door glass 170, and may be slanted tilted downward in a rear direction.

Since the second opening 180*a* is arranged at an upper side of the door glass 170, laundry or detergent introduced through the second opening 180*a* may be introduced into the drum 30 along the introduction guide surface 172*a*. The introduction guide surface 172*a* may be slanted downward in the rear direction of the door assembly 110, and the center part of the introduction guide surface 172*a* may be concave downward of lateral side parts of the introduction guide surface 172*a*. The introduction guide surface 172*a* may allow laundry or detergent introduced through the second opening 180*a* to be easily put into the drum 30.

The introduction guide surface 172*a* may be formed to extend from a connection guide surface 180*c* which will be described later. The introduction guide surface 172*a* may allow laundry or detergent guided by a connection guide surface 180*c* to be introduced into the cabinet 10.

Although the introduction guide surface 172*a* disclosed in this embodiment is downwardly concave, the shape of the introduction guide surface 172*a* is not limited thereto. For example, the introduction guide surface 172*a* may be upwardly convex, or may be formed parallel to the rear end of the second opening 180*a* with the same height of the rear end of the second opening 180*a*.

The door glass 170 may further include a glass flange 174 formed in a flange shape provided at the end of the glass body 172 such that the door glass 170 may be seated on the rear holder 140. The glass flange 174 may be seated on a glass seating part 146 of the rear holder 140 such that the door glass 170 is not separated from the door assembly 110.

The rear holder 140 may be provided at the rear of the front cover 130.

The rear holder 140 may include a holder body 142 and a holder opening 144. The holder opening 144 may be provided in the holder body 142 to form at least one part of the second opening 180*a*. The holder body 142 may form at least one part of the rear surface of the door assembly 110.

The door body 120 of the door assembly 110 may include the connection part 180. The connection part 180 may form the second opening 180*a*. The front end of the connection part 180 may be arranged at an inside of the cover opening 134 of the front cover 130, and the rear end of the connection part 180 may be arranged at an inside of the holder opening 144 of the rear holder 140. That is, the connection part 180 may be provided between the front cover 130 and the rear holder 140 so as to form the second opening 180*a* communicating inside with outside of the cabinet.

The connection part 180 may be provided in the form of a tube, both sides of which are opened. In detail, the second opening 180*a* may be formed at one side of the connection part 180, and a discharge opening 180*b* facing the interior of the cabinet 10 may be formed at the other side of the connection part 180. Laundry or detergent introduced through the second opening 180*a* may be delivered to the discharge opening 180*b* through a hollow part 180*d* formed in the connection part 180 such that the laundry or detergent may be introduced into the cabinet 10.

The connection part 180 may include the connection guide surface 180*c*. The connection guide surface 180*c* may be provided to form the bottom surface of the connection part 180. The connection guide surface 180*c* may be formed between the second opening 180*a* and the discharge opening 180*b*, such that laundry or detergent introduced through the second opening 180*a* may be guided to the inside of the cabinet 10 through the discharge opening 180*b*.

The shape of the connection guide surface 180*c* is not limited thereto. For example, the connection guide surface 180*c* may be slanted downward in the direction from the front side to the rear side of the washing machine.

The connection part 180 may be provided to have the second opening 180*a* formed to be higher than the discharge opening 180*b*. That is, the connection part 180 may be provided to have an inclination that is inclined downwardly to the rear side of the washing direction thereof. When laundry or detergent is introduced through the second opening 180*a*, the laundry or detergent may be easily introduced into the cabinet 10 through the connection part 180 having a descending slope in the rear direction.

A front sealing part 182 may be provided at a front side of the connection part 180, and a rear sealing part 184 may be provided at a rear side of the connection part 180.

The front sealing part 182 may be provided at a front end of the connection part 180 so as to form a sealing structure by making contact with the auxiliary door 160. A front sealing groove 183 to which the front sealing part 182 is fixed may be formed at the front end of the connection part 180.

The front sealing part 182 may be formed adjacent to the second opening 180*a*, so that when the second opening 180*a* is closed by the auxiliary door 160, the front sealing part 182 is brought into contact with the auxiliary door 160, to form a sealing structure. The front sealing part 182 may be formed along the circumference of the second opening 180*a*.

Since the front sealing part 182 and the auxiliary door 160 form the sealing structure in the second opening 180*a*, water leakage from the cabinet 10 may not occur when the auxiliary door 160 is closed.

The rear sealing part 184 may be provided at the rear of the connection part 180, such that the sealing structure may be formed between the rear end of the connection part 180 and the holder opening 144. A rear sealing groove 185 to which the rear sealing part 184 is fixed may be formed at the rear end of the connection part 180. Since the holder opening 144 is arranged along the circumference of the discharge opening 180*b*, the rear sealing groove 185 may be formed at an outside of the rear end of the connection part 180.

The rear sealing part 184 may be formed adjacent to the discharge opening 180*b*, such that the sealing structure may be formed between the holder opening 144 and the rear sealing part 184. The rear sealing part 184 may be arranged adjacent to the discharge opening 180*b* along the circumference of the discharge opening 180*b*.

The rear sealing part and the holder opening 144 may form the sealing structure in the discharge opening 180*b*, such that occurrence of water leakage from the inside of the cabinet 10 to the inside of the door assembly 110 may be prevented.

Although the connection part 180 is disposed between the front cover 130 and the rear holder 140, the arrangement and configuration of the connection part 180 are not limited thereto. For example, the connection part 180 may be integrally formed with the front cover 130 or the rear holder 140. In addition, the connection part 180 may be integrally formed with the front cover 130 and the rear holder 140. That is, the connection part 180 may be integrally formed with at least one of the front cover 130 and the rear holder 140.

The rear holder 140 may include the glass seating part 146 in which the door glass 170 is seated. A rear glass hole 148 may be formed in the glass seating part 146 such that the glass body 172 passes through the rear glass hole 148. In addition, the glass flange 174 may be seated in the rear of the glass seating part 146, such that the door glass 170 may not be separated from the rear holder 140. A seating sealing part 149 for preventing water leakage may be disposed between the glass seating part 146 and the glass flange 174.

The rear holder 140 may include a door sealing unit 150.

When the first opening 2*a* is closed by the door assembly 110, the door sealing unit 150 may seal the interior of the cabinet 10 by making contact with the diaphragm 90. The door sealing unit 150 may be formed in a ring shape corresponding to the ring-shaped diaphragm 90. The door sealing unit 150 may be provided to make contact with the entire area of the circumference of the diaphragm 90, to form the sealing structure for preventing wash water stored in the cabinet 10 from leaking outside through the first opening 2*a*. Although the door sealing unit 150 according the embodiment is formed in a ring shape, the door sealing unit 150 may have a polygonal shape or an elliptical shape to match the diaphragm 90.

The second opening 180*a* may be spaced inwardly apart from the door sealing unit 150. The second opening 180*a* may be spaced apart from the door sealing unit 150 at an inside of the door sealing unit 150, so that the second opening 180*a* is not interfered with the diaphragm 90 when the first opening 2*a* is closed by the door assembly 110. Moreover, the holder opening 144 formed along the circumference of the second opening 180*a* may be spaced inwardly apart from the door sealing unit 150.

The door glass 170 may be spaced inwardly apart from the door sealing unit 150. The door glass 170 may be spaced apart from the door sealing unit 150 at an inside of the door sealing unit 150, so that the door glass 170 is not interfered with the diaphragm 90 when the first opening 2*a* is closed by the door assembly 110. In accordance with the embodiment of the present disclosure, the second opening 180*a* and the door glass 170 may be spaced apart from the door sealing unit 150 at an inside of the door sealing unit 150. In detail, the rear end of the second opening 180*a* and the door glass 170 may be spaced apart from the door sealing unit 150 at an inside of the door sealing unit 150.

The door sealing unit 150 may be formed of a material capable of forming the sealing structure by making contact the diaphragm 90. For example, the door sealing unit 150 may include at least one of a glass material and an elastic member. In addition, the door sealing unit 150 may also be formed of a smooth-surface material. In addition, the door sealing unit 150 may be injection-molded together with the rear holder 140. The material of the door sealing unit 150 is not limited thereto, and the door sealing unit 150 may also be formed of any material that forms a sealing structure together with the diaphragm 90 while making contact with the diaphragm 90.

The second opening 180*a* may have a size smaller than that of the first opening 2*a*. The first opening 2*a* may be provided in the cabinet 10 so as to be opened or closed by the door assembly 110. The second opening 180*a* may be provided in the door assembly 110 so as to be opened or closed by the auxiliary door 160. According to such a structure, even when the first opening 2*a* is closed by the door frame 120, a user may put additional laundry or detergent into the cabinet 10 by opening the second opening 180*a*.

Figure 6:
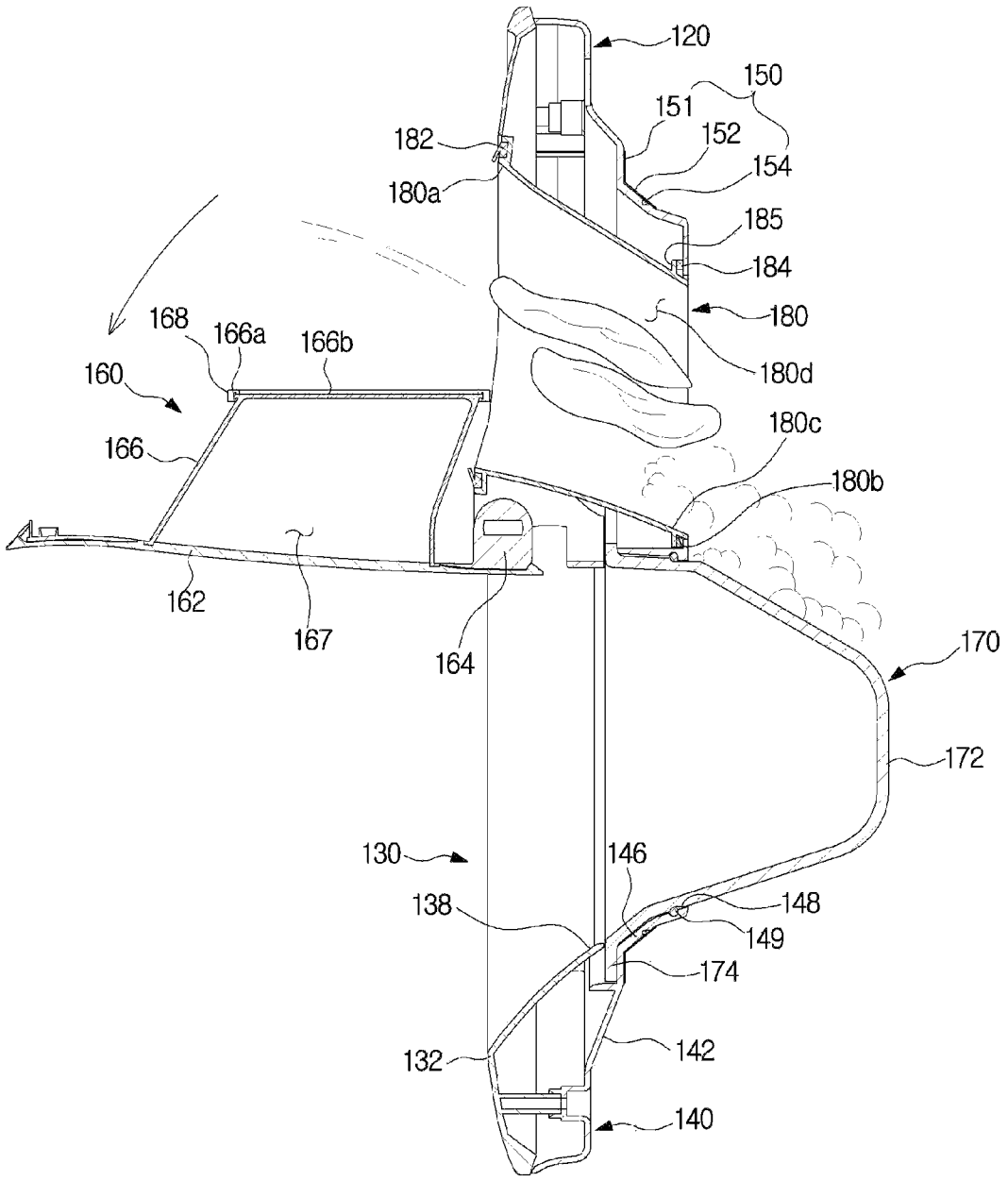
FIG. 6 is a view illustrating an auxiliary door included in a door assembly which is opened according to an embodiment of the present disclosure.

FIG. 6 is a view illustrating an auxiliary door included in a door assembly which is opened according to an embodiment of the present disclosure.

Referring to FIG. 6, the door assembly 110 may include the auxiliary door 160 through which a user may put additional laundry or detergent into the drum 30 during the washing operation of the washing machine 100. The auxiliary door 160 may be provided to be pivoted about the auxiliary door hinge part 164.

Prior to beginning of the washing operation, a user may put laundry into the drum 30 by opening the door assembly 110. After laundry and detergent are introduced into the drum 30, a washing operation may be established and the washing machine 100 may perform the washing operation. When the washing operation starts, the door assembly 110 may be locked not to be opened at random. The locking of the door assembly 110 may be released when the washing operation is completed. In addition, when the washing operation is stopped by a user before the washing operation is complemented, the locking of the door assembly 110 may be released after wash water stored in the drum 30 is completely drained.

The washing machine according to the present disclosure includes the auxiliary door 160, such that a user may put additional laundry or detergent into the drum 30 through the second opening 180*a* by opening the auxiliary door 160 during the washing operation. Since the user may put additional laundry or detergent into the drum by simply opening the auxiliary door 160 during the washing operation, so that usability of the washing machine 100 may be improved.

When detergent and wash water are supplied into the drum 30 and the washing operation is started, detergent bubbles may be generated in the drum 30. As the washing operation proceeds, the top level of the detergent bubbles may gradually ascend to the upper side of the interior of the drum 30. Therefore, if a user opens the auxiliary door 160 after the washing operation is performed, detergent bubbles contained in the drum 30 may flow outside the washing machine 100. If detergent bubbles flow outside the washing machine 100, the surrounding area of the washing machine 100 becomes messy and a safety accident may occur.

In accordance with one embodiment of the present disclosure, the auxiliary door glass 166 may be formed to protrude from the rear part of the auxiliary door body 162 of the auxiliary door 160. Even when wash water and detergent are supplied into the drum 30 and the washing operation is started, detergent bubbles in the drum 30 may reach only the outside of the bottom surface 166*b* of the auxiliary door glass 166 due to the auxiliary door glass 166.

The auxiliary door glass 166 protruding backward from the auxiliary door body 162 allows the second opening 180*a* to be spaced apart from the detergent bubbles contained in the drum 30 by a predetermined distance corresponding to the length of the side surface part 166*a* protruding backward from the auxiliary door body 162. Therefore, even when the auxiliary door 160 is opened by a user during a washing operation, detergent bubbles in the drum 30 are prevented from flowing outside through the second opening 180*a*.

The sealing member 168 may be provided at the outside of the auxiliary door glass 166, such that the space between the connection part 180 located outside the auxiliary door glass 166 and the auxiliary door glass 166 may be sealed. Even if the washing operation is performed and wash water is supplied into the drum 30, the wash water and detergent bubbles are not introduced into the space between the auxiliary door glass 166 and the connection part 180, such that the wash water or the detergent bubbles may not adhere to the outer surface of the auxiliary door glass 166. Therefore, when the auxiliary door 160 is opened by the user during the washing operation, the sealing member 168 may prevent water or detergent bubbles from sticking to the outer surface of the auxiliary door glass 166 and flowing outside the washing machine 100.

Figure 7:
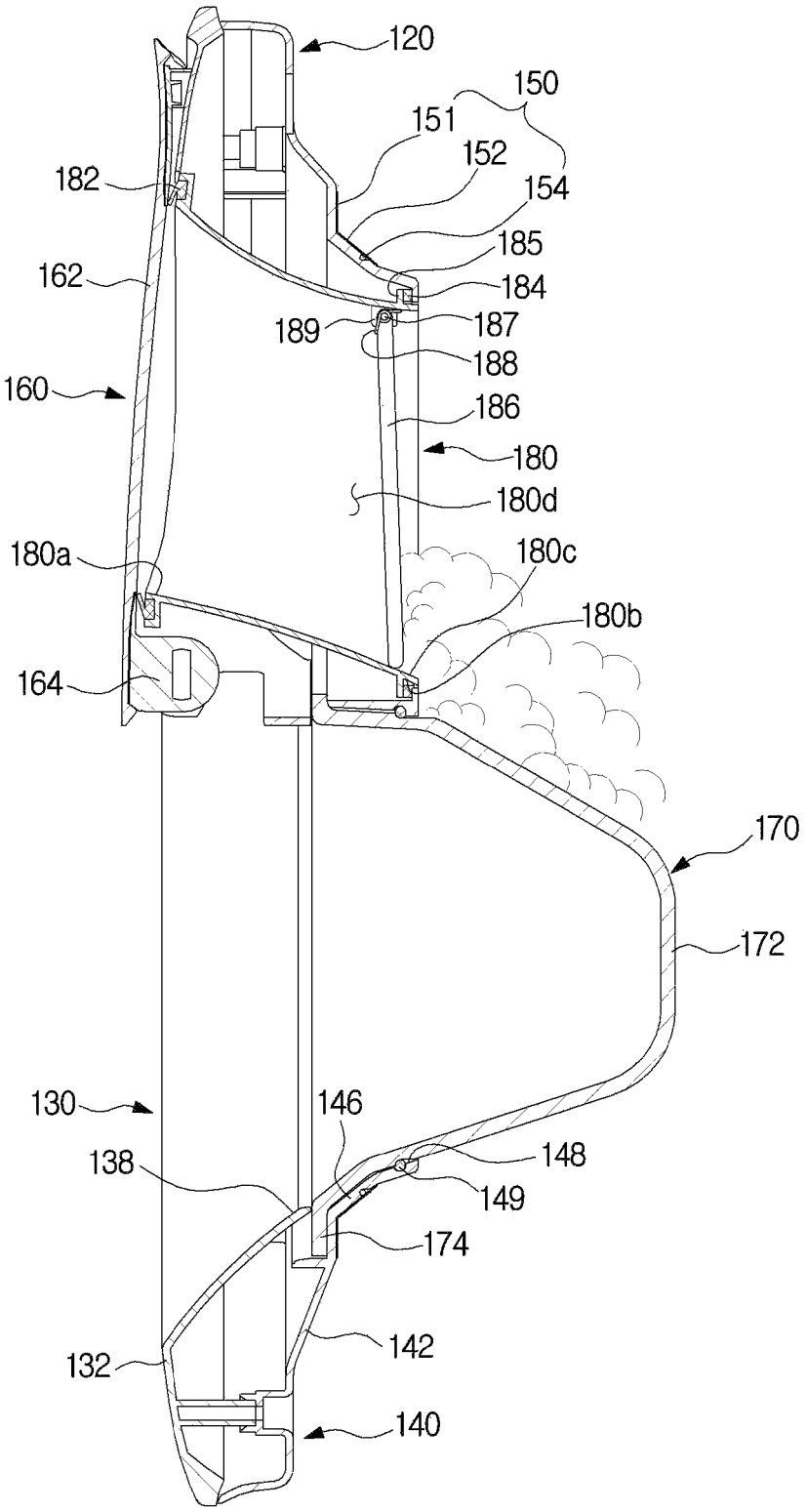
FIG. 7 is a view illustrating a door assembly according to another embodiment of the present disclosure.
Figure 8:
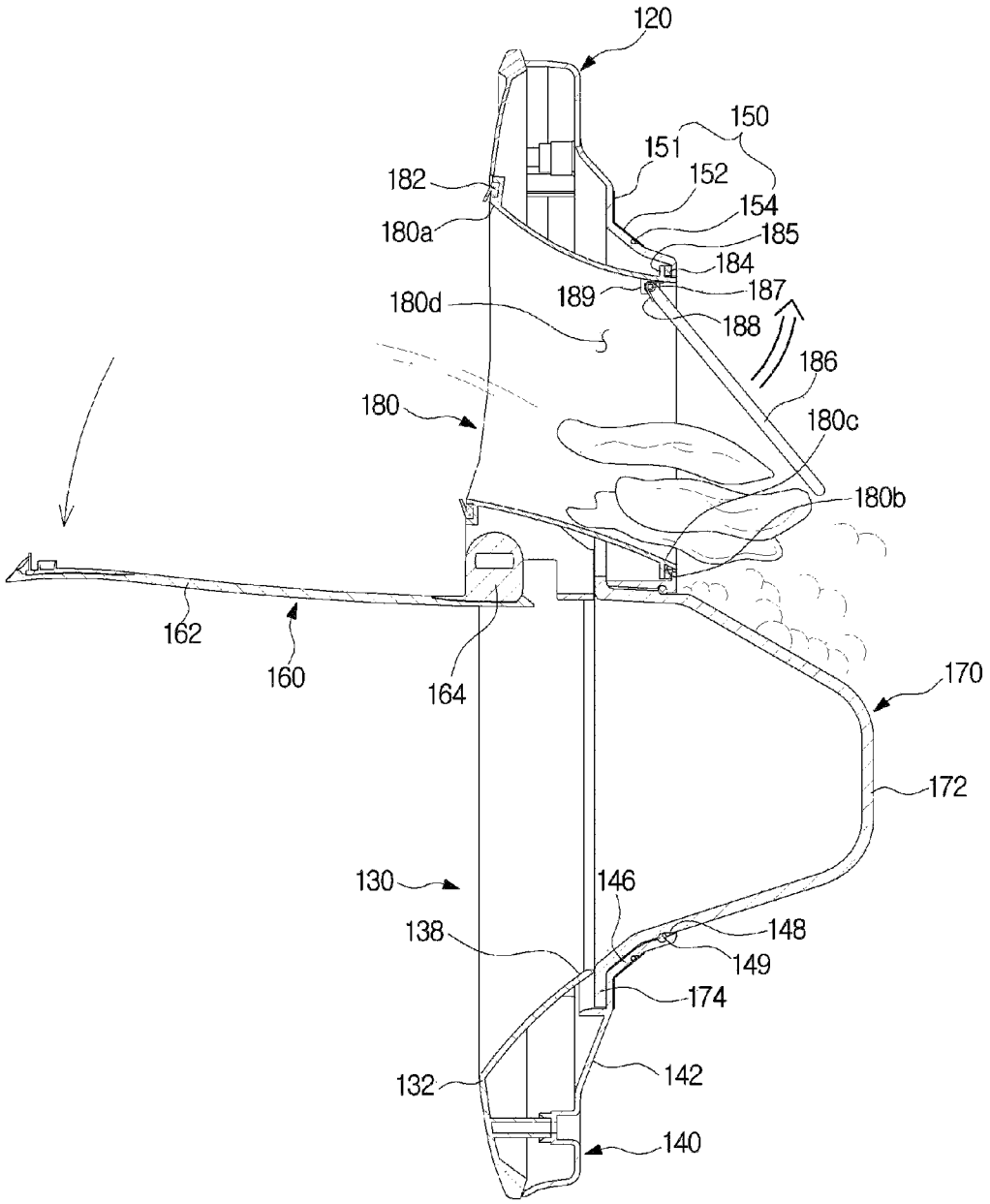
FIG. 8 is a view illustrating an auxiliary door included in a door assembly which is opened according to another embodiment of the present disclosure.

FIG. 7 is a view illustrating a door assembly according to another embodiment of the present disclosure. FIG. 8 is a view illustrating an auxiliary door included in a door assembly which is opened according to another embodiment of the present disclosure.

Referring to FIGS. 7 and 8, the door assembly 110 according to another embodiment may include a cap 186 to selectively open the connection part 180. The cap 186 may be positioned in the connection part 180 or at the rear of the connection part 180 while being spaced apart from the auxiliary door body 162 by a predetermined distance.

The remaining constituent elements other than the cap 186 located at the rear of the connection part 180 may be similar to the concept of the door assembly 110 shown in FIGS. 3 to 5. However, the auxiliary door glass 166 may not be located at the rear of the auxiliary door body 162 of the door assembly 110 illustrated in FIGS. 7 and 8.

The cap 186 may rotate about a rotation shaft 187. The mounting part 189 to which the rotation shaft 187 is mounted may be arranged at one side of the connection part 180. The mounting part 189 may protrude inward from the rear of the connection part 180.

An elastic member 188 for providing elastic force to the cap 186 may be mounted to the rotation shaft 187. The elastic member 188 may provide elastic force such that the cap 186 closes the connection part 180 so far as no external force exists. The cap 186 is located at the rear of the connection part 180 so that the rear part of the connection part 180 may be selectively opened. For example, the cap 186 may selectively open the rear end of the connection part 180.

Since the cap 186 is located at the rear part of the connection part 180 such that the rear part of the connection part is closed, wash water or detergent bubbles in the drum 30 may not leak to the connection part 180 even if the washing operation is performed. That is, the cap 186 prevents wash water or detergent bubbles in the drum 30 from being introduced into the space formed by the auxiliary door body 162, the connection part 180, and the cap 186.

The cap 186 may be formed of a ductile material such as rubber or silicon. Accordingly, the quality of sealing between the cap 186 and the connection part 180 is improved, such that wash water or detergent bubbles may not leak into the space formed by the auxiliary door body 162, the connection part 180, and the cap 186.

The cap 186 may be formed of a rigid material, and the sealing member may be arranged around an outer circumference of the cap 186 which makes contact with the connection part 180. For example, the cap 186 may be formed of a metal or plastic material, and the sealing member may be mounted to an outer circumferential surface of the cap 186. Although the sealing member is illustrated as being arranged around the outer circumference of the cap 186, the installation position of the sealing member is not limited thereto as long as the space between the cap 186 and the connection part 180 is sealed by the sealing member.

Since the connection part 180 is closed by the cap 186, wash water or detergent bubbles in the drum 30 may not be introduced to the inside of the connection part 180. Therefore, even if the auxiliary door 160 is opened by a user during a washing operation, the connection part 180 is in a state of being closed by the cap 186, and therefore, wash water or detergent bubbles in the drum 30 do not flow to the outside of the washing machine 100 through the connection part 180.

The cap 186 may rotate about the rotation shaft 187 by an external force. The cap 186 may rotate about the rotation shaft 187 so as to have one side thereof directed to the rear part at which the drum 30 is located. As described above, the cap 186 rotates about the rotation shaft 187 by an external force, such that the rear side of the connection part 180 may be opened.

When the user desires to additionally put laundry or detergent into the drum after the auxiliary door 160 is open, the user may open the connection part 180 by pushing the cap 186. That is, the user may open the connection part 180 by pushing the cap 186, and may additionally put laundry or detergent into the drum 30 through the opened connection part 180.

Since the cap 186 is spaced apart from the rear side of the auxiliary door 160 by a predetermined distance, detergent bubbles in the drum 30 may be prevented from easily flowing to the outside the washing machine 100 through the second opening 180*a*. In addition, since the connection part 180 is closed by the cap 186, water or detergent bubbles may be prevented from sticking to the rear surface of the auxiliary door body 162. Therefore, when the auxiliary door 160 is opened, water or detergent bubbles attached to the rear surface of the auxiliary door body 162 may be prevented from flowing to the outside of the washing machine 100.

Not only the auxiliary door glass 166 located at the rear of the auxiliary door body 162 as illustrated in FIGS. 3 to 6, but also the cap 186 covering the connection part 180 while being spaced apart from the auxiliary door body 162 by a predetermined distance as illustrated in FIGS. 7 and 8 may be spaced apart from the rear surface of the auxiliary door body 162 by a predetermined distance so as to prevent detergent bubbles in the drum 30 from being introduced to the front of the washing machine. Accordingly, the auxiliary door glass 166 and the cap 186 may be referred to as an interference part. A predetermined space is formed in the rear of the auxiliary door 160 by the interference part, such that wash water and detergent bubbles in the drum 30 may be prevented from being introduced to the front of the washing machine.

Figure 9:
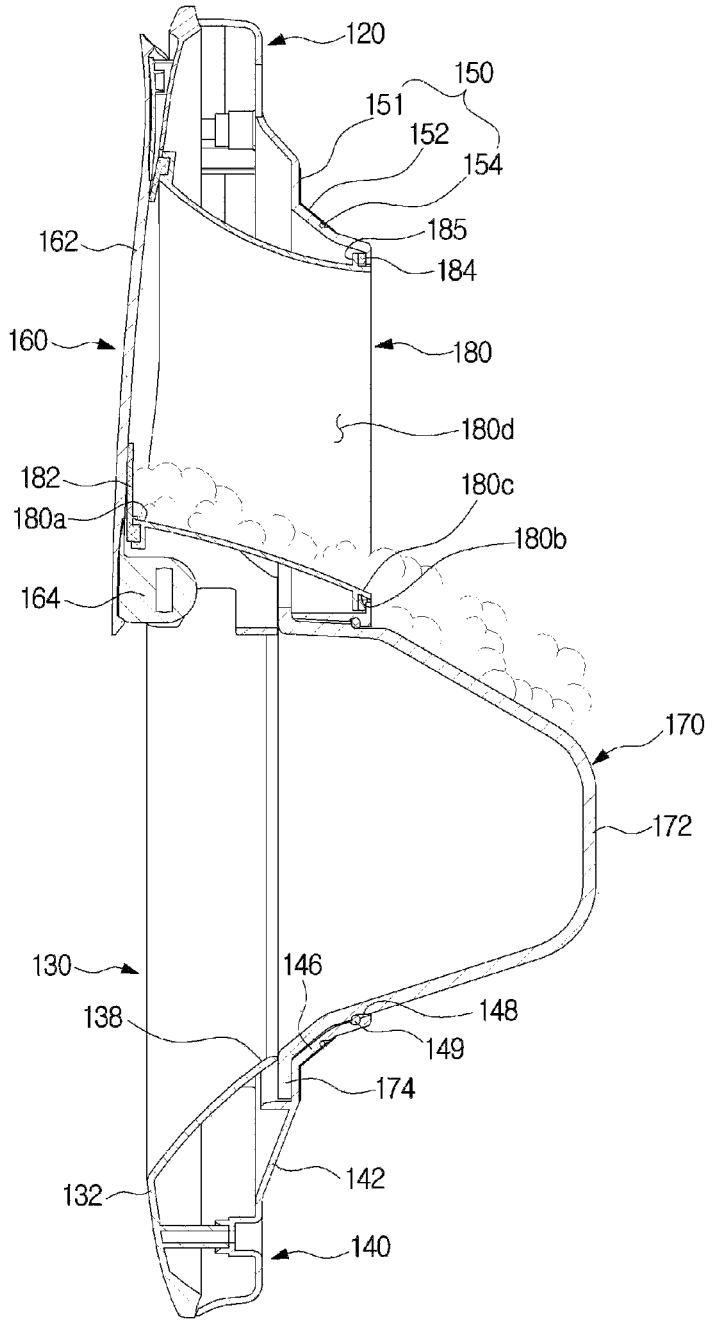
FIG. 9 is a view illustrating a door assembly according to still another embodiment of the present disclosure.
Figure 10:
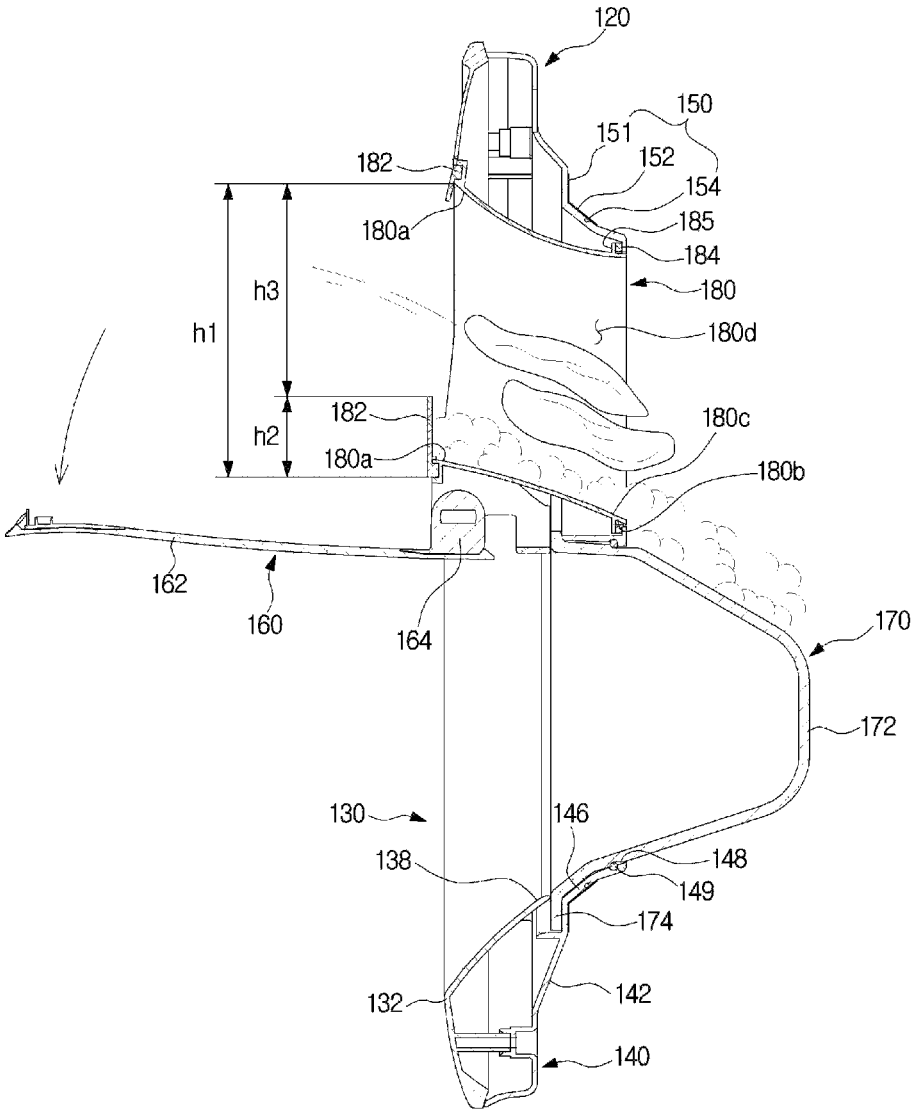
FIG. 10 is a view illustrating an auxiliary door included in a door assembly which is opened according to still another embodiment of the present disclosure.

FIG. 9 is a view illustrating a door assembly according to still another embodiment of the present disclosure. FIG. 10 is a view illustrating an auxiliary door included in a door assembly which is opened according to still another embodiment of the present disclosure.

Referring to FIGS. 9 and 10, the front sealing part 182 included in the door assembly 110 according to still another embodiment may partially cover the second opening 180*a*. The front sealing part 182 is formed adjacent to the second opening 180*a*. When the auxiliary door 160 is closed, the auxiliary door 160 is brought into contact with the front sealing part 182, such that the sealing structure is formed.

The front sealing part 182 may be arranged along the circumference of the second opening 180*a*. The front sealing part 182 may protrude upward by a predetermined height (h2) so as to cover a portion of the lower part of the second opening 180*a*. When the vertical height of the second opening 180*a* is denoted by h1, the upward protruding length of the portion of the lower part of the front sealing part 182 partially covering the second opening 180*a* is denoted by h2.

In the second opening 180*a*, a part corresponding to height (h3) obtained when the height (h2) of the front sealing part 182 is subtracted from the height (h1) of the second opening 180*a* may be selectively opened by the auxiliary door 160. When the auxiliary door 160 is opened, the user may additionally put laundry or detergent into the drum 30 through the part corresponding to the height (h3) of the second opening 180*a*.

Since a portion of the lower part of the second opening 180*a* is covered by the front sealing part 182, detergent bubbles in the drum 30 are prevented from easily flowing to the outside of the washing machine 100.

The front sealing part 182 may be formed of deformable material such as rubber or silicon. When a portion of the lower part of the second opening 180*a* is covered by the front sealing part 182, the user desires to put laundry larger than the upper portion of the second opening 180*a* which is not covered by the front sealing part 182 into the drum 30, the front sealing part 182 may be deformed by a force pushing the front sealing part 182, such that large-sized laundry may be easily introduced into the drum 30.

The structure of the front sealing part 182 illustrated in FIGS. 9 and 10, the structure of the auxiliary door glass 166 illustrated in FIGS. 3 to 6, and the structure of the cap illustrated in FIGS. 7 and 8 may be used individually or as a combination of two or more embodiments described above.

As described above, the washing machine 100 according to the embodiments may prevent detergent bubbles in the drum 30 from flowing to the outside of the washing machine 100 when the auxiliary door 160 is opened, the surrounding area of the washing machine 100 may be kept clean in sanitary condition, and safety accident due to detergent bubbles and wash water flowing to the outside of the washing machine 100 may be prevented.

As is apparent from the above description, the washing machine according to the embodiments can prevent bubbles in the drum from flowing to the outside when the auxiliary door is opened during the washing process, thereby preventing consumer complaints and safety accidents.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a cabinet including a first opening;

a tub disposed in the cabinet and configured to store wash water therein;

a drum rotatably disposed in the tub;

a door assembly mounted to the cabinet to open or close the first opening, and including a second opening;

an auxiliary door configured to open or close the second opening;

a connection part forming the second opening and inclined downwardly to a rear side of the washing machine so as to connect the auxiliary door to the drum and to guide a laundry to the inside of the drum;

an interference part located at a rear of the auxiliary door to form a predetermined space in the rear of the auxiliary door; and a cap spaced apart from the auxiliary door to open and close one side of the connection part, wherein the interference part include an auxiliary door glass protruding downward from a front side to the rear side of the washing machine so as to correspond to the connection part, wherein the connection part includes a hollow part to introduce the laundry the drum, wherein the auxiliary door glass is accommodated in the hollow part and configured to prevent the wash water inside the drum from flowing out through the hollow part, and wherein the cap is rotatably installed on one side of the connection part about a rotation shaft and configured to open and close the one side of the connection part while the first opening is closed by the door assembly.

2. The washing machine according to claim 1, wherein the auxiliary door glass simultaneously moves together with the auxiliary door.

3. The washing machine according to claim 1, wherein a sealing member is mounted to an outer side of the auxiliary door glass, and when the auxiliary door is closed, a space between the auxiliary door glass and the connection part is sealed by the sealing member.

4. The washing machine according to claim 1, wherein the auxiliary door glass includes:

a side surface part protruding backward from the auxiliary door; and a rear surface part connected to the side surface part, and located to face the auxiliary door.

5. The washing machine according to claim 1, wherein the auxiliary door and the auxiliary door glass are formed of transparent material.

6. The washing machine according to claim 1, wherein the rotation shaft is provided with an elastic member configured to provide the cap with an elastic force in a direction the cap closes the one side of the connection part.

7. The washing machine according to claim 6, wherein the cap is configured to open the one side of the connection part by an external force in an opposite direction to the elastic force applied to the elastic member.

8. The washing machine according to claim 1, wherein a front sealing part is located at a front of the connection part to seal a space between the connection part and the auxiliary door.

9. The washing machine according to claim 8, wherein:

a portion of a lower part of the front sealing part is extended upward to partially cover the second opening.

10. The washing machine according to claim 8, wherein the front sealing part is formed of flexible material such that the front sealing part is deformed by an external force.

* * * * *